United States Patent [19]

Iwakawa et al.

[11] Patent Number: 4,859,910

[45] Date of Patent: Aug. 22, 1989

[54] PLASMA DISPLAY APPARATUS

[75] Inventors: Tsunekiyo Iwakawa; Hiroshi Hada; Tadashi Nakamura, all of Tokyo, Japan

[73] Assignee: NEC Corporation, Japan

[21] Appl. No.: 76,368

[22] Filed: Jul. 22, 1987

[30] Foreign Application Priority Data

Jul. 22, 1986 [JP] Japan ..... 61-173104

[51] Int. Cl.[4] ..... G09G 3/10

[52] U.S. Cl. ..... 315/169.1; 315/169.2; 315/169.3; 315/169.4; 340/771; 340/805

[58] Field of Search ..... 315/169.1, 169.2, 169.3, 315/169.4; 340/771, 805, 776

[56] References Cited

U.S. PATENT DOCUMENTS

| | | | |
|---|---|---|---|
| 3,869,644 | 3/1975 | Yano et al. | 315/169.4 |
| 4,496,879 | 1/1985 | Suste | 315/169.1 |
| 4,595,919 | 6/1986 | Holz et al. | 315/169.1 |

*Primary Examiner*—Leo H. Boudreau

*Assistant Examiner*—Michael Razavi

*Attorney, Agent, or Firm*—Laff, Whitesel, Conte & Saret

[57] ABSTRACT

The invention provides voltage potential differences for selectively discharging cells in a plasma display device, with greater brightness and reduced power consumption. The plasma display device has orthogonally related electrodes sealed in an atmosphere of neon gas. When a predetermined potential is applied between two intersecting electrodes, the neon gas glows at the intersection. The predetermined potential is achieved by applying two pulse trains which have opposite phases and therefore oppositely going voltage polarities. The difference in the oppositely going peak voltages of the two pulse trains provides a firing potential at the selected intersection. To reduce power consumption, the cell at the intersection is fired at a high potential during an address mode and thereafter held in a glowing state by a greatly reduced voltage. Another embodiment produces a similar result by changing the frequency of driving pulses in the firing and the holding modes.

6 Claims, 5 Drawing Sheets

Tv
Th

1st ROW
Vo
0
Tc
Ta
Tb m th COLUMN
V1
0 n th COLUMN
V1
0

Vo
Vo-V1
0
-V1

Vo
Vo-V1
0

Tv

Vo
1st ROW
0
Th

Vo
2nd ROW
0
Tc
Tc

Vo
3rd ROW
0
Th
Tv

Th

Th

Vo
Nth ROW
0

V1
mth COLUMN
0

V1
nth COLUMN
0
Tc
Ta
Tb

Vo
Nth ROW-mth COLUMN CELL
0
-V1

Vo-V1
0
Nth ROW-nth COLUMN CELL
-V1

Th

Vo
1st ROW
0
Tc
Ta
Tb
Ta
Tb

V1
m th COLUMN
0

V
n th COLUMN
0

Vo
1st ROW-m th COLUMN CELL
0
-V1

V -V1
1st ROW-m th COLUMN CELL
0
-V1

PLASMA DISPLAY APPARATUS

BACKGROUND OF THE INVENTION

This invention relates to a plasma display apparatus and more particularly to means for driving AC refresh-type plasma display panel.

A typical example of a conventional AC refresh-type plasma display panel (PDP) which is to be used in the present invention comprises two glass plates having electrode groups which are coated with a dielectric layer. The two glass plates are arranged in a manner which makes electrode groups thereof opposed to each other. Electrodes in each group intersect each other perpendicularly to form a matrix display type. The glass plates are sealed air-tight with glass frits. Neon gas fills in the sealed space surronded by the glass plates.

When the driving circuit applies a pulsed voltage to only one electrode group while maintaining the other electrode group at potential zero discharge occurs between the electrodes. The voltage discharged at the cell which is the most easy to discharge within the PDP is defined as the minimum unilateral discharge voltage (VDmin). The voltage discharged at the cell which is the most unlikely to discharge within the PDP is defined as the maximum unilateral discharge voltage (VDmax). If one electrode group of the PDP has a first pulse train applied thereto with a high voltage ($V_0$) which is higher than VDmin but lower than VDmax while the other electrode group has a second pulse train applied thereto with a low voltage (V1) which has a phase which is the same as or opposite to the first pulse train, the discharge does not occur when the relation holds; $VDmin > |V0| - |V1|$ and discharge occurs when the relation holds; $VDmax < |V0| + |V1|$.

U.S. Pat. No. 3,869,644 issued on Mar. 4, 1975 discloses a phase-select method using the above condition as one example of the prior art AC refresh-type driving circuits for plasma display panels (PDP). In this prior art driving circuit, while a first pulse train of high voltage is applied to scanning electrodes in a time division mode. A second pulse train of low voltage, having the phase opposite to the phase of the first pulse train, is applied to selected data electrodes associated with the cell which is selected to discharge. In addition, a third pulse train of low voltage having the phase which is the same as the phase of the first pulse train is applied to remaining data electrodes associated with non-selected cells so as not to discharge the non-selected cells, thereby securing a stable operation.

In this prior art driving circuit, however, driving circuits are electrically connected via stray capacities between adjacent data electrodes provided on the substrate of PDP. When the adjacent data electrodes are driven for discharging and non-discharging concurrently, the power consumption of the driving circuits for the adjacent data electrodes becomes maximum. Although the brightness of an AC refresh-type PDP is determined by the number of pulses contained in a unit time, the larger the number of pulses becomes, the larger the power consumption of the driving circuits becomes. Thus the restrictions on the driving frequency present a formidable obstacle in obtaining sufficient brightness.

The prior art driving circuit is further detrimental in that if there is mismatch in time of high frequency pulses between voltages applied to the scanning electrodes and the data electrodes, the range of the driving voltage becomes narrow.

Moreover, if transparent electrodes are used for data electrodes, a distributed constant circuit is formed via stray capacity between the transparent electrodes. As the waveforms and voltages at a top end of the transparent electrodes differ from the waveforms and voltage at an input end, the brightness fluctuates unevenly. This also causes a delay in time and changes in voltage between the first pulse train for the scanning side and the second and third pulse trains for the data side. The range of driving voltage inconveniently becomes narrower.

SUMMARY OF THE INVENTION

It is, therefore, an object of this invention to provide a driving method means and for plasma display panels which result in a high level of brightness, small power consumption and a larger operating range.

According to this invention, the potential difference applied to either selected cells or non-selected cells during one scanning cycle includes a period of an address mode and a period of a hold mode. In the address mode period, a potential difference larger than $VD_{max}$ is applied to discharge the selected cells while a potential difference smaller than $VD_{min}$ is applied to not discharge the non-selected cells. In the hold mode period, on the other hand, the potential difference applied to both the selected cells and the non-selected cells is reduced, but the potential difference has the same amplitude which is such that the selected cells can continue in the discharge state while the non-selected cells require enough time to start a discharge. The time delay may vary depending on the amplitude of the potential difference, but generally becomes 5 micro sec. or more in the AC refresh-type method. The response to a discharge is extremely fast, once it is started, and is less than 100 nano sec. due to ions and electrons filled in the selected cells.

The present invention uses this phenomenon of discharge jitter. More particularly, the address mode can be obtained by applying a pulse train of low voltage to a data electrode with the phase opposite to or identical with the pulse train of high voltage applied to a scanning electrode. The hold mode can be obtained by applying a DC voltage to the data electrode.

DESCRIPTION OF PREFERRED EMBODIMENTS

Figures 1A, 1B, 1C, 1D, 1E:
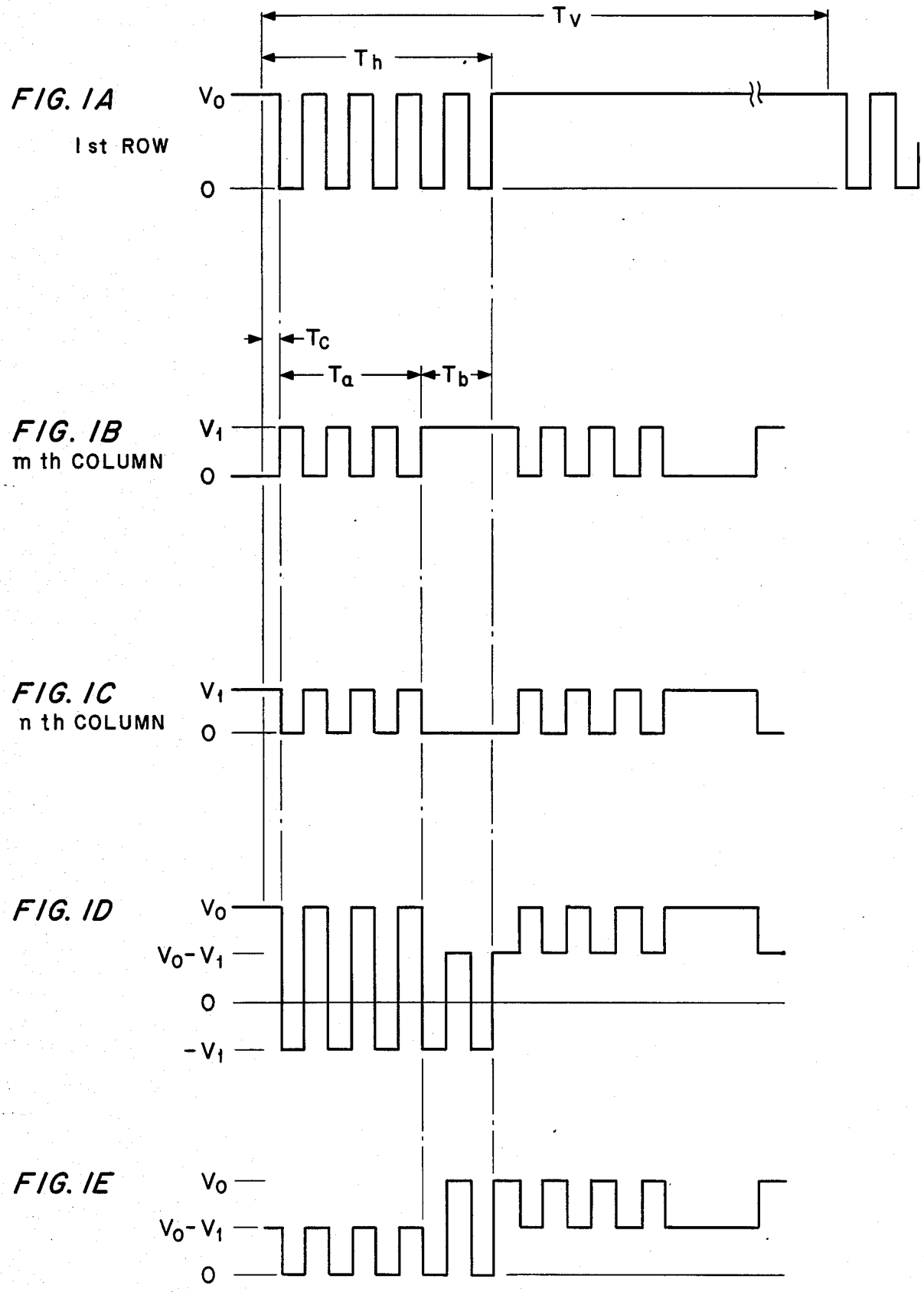
FIGS. 1A to 1E are waveform diagrams showing a relationship between the voltages applied to a scanning electrode and data electrodes, according to a first preferred embodiment of this invention.

Referring to FIG. 1, while a first pulse train of peak voltage $V_0$ is applied to the first scanning or row electrode for one scanning period Th, as shown in FIG. 1A, a second pulse train of peak voltage $V_1$ is applied to the mth data or column electrode for a period Ta which is shorter than the period Th as shown in FIG. 1B. Following the pulse train for the period Ta, a direct current voltage is applied to the mth column electrode for a period Tb as shown in FIG. 1B. The period represented by the letter Tc in FIG. 1 is a blanking period. Thus the sum of the periods, Ta+Tb+Tc, indicates the one scanning period Th.

As is shown in FIG. 1B, the second pulse train has a phase which is opposite to the phase of the first pulse train so as to produce a first pulsing potential difference shown in FIG. 1D. This first potential difference is larger than the firing voltage of the selected cell which is formed at the intersection of the first row electrodes and the mth column electrode. When the nth column electrode is associated with a non-selected cell which is not to be discharged, a third pulse train of peak voltage $V_1$ is applied to the nth column electrode for the period Ta with a phase which is identical to the phase of the first pulse train as shown in FIG. 1C. During the period Tb, the nth column electrode also has a direct current voltage applied thereto. FIG. 1E shows the potential difference applied to a non-selected cell formed at the intersection of the first row electrode with the nth column electrode.

The operation during the period Ta, in the one scanning period Th, is identical to the operation disclosed in the aforementioned U.S. Pat. No. 3,869,644. The period Ta is defined herein as an address mode. The potential difference $V_0$, which is applied to the selected cells and non-selected cells during the period Tb in the one scanning period Th, are completely identical to each other, as shown in FIGS. 1D and 1E. This period is referred herein as a hold mode.

At the address mode, if the relations set forth below hold, the selected cells which are to glow are discharged and the non-selected cells which are not to glow are not discharged;

$$VD\max < |V1| + |V0| \quad (1)$$

$$VD\min > |V0| - |V1| \quad (2)$$

In the hold mode, the potential difference $V_0$ is applied irrespective of whether the cells are to glow or are not to glow. The cells maintain the state which is created at the address mode which preceded the hold mode.

More particularly, as the selected cell is discharged at the period Ta, the selected cell is filled with charged particles generated by the discharge; thus, the following discharge is easily actuated even in the hold mode where the potential difference which is applied is lower than the potential difference which is applied in the address mode.

Since the non-selected cell is not discharged in the address mode period Ta, the non-selected cell is not filled with charged particles. Therefore, it takes a certain time before the non-selected cell starts to discharge in the subsequent period Tb, with the potential difference $V_0$. Accordingly, if a suitable period is selected, for instance, at 20 micro second or less for the perior Tb, it is possible to determine the voltage which will not start a discharge at the hold mode.

Figures 2A, 2B, 2C, 2D, 2E:
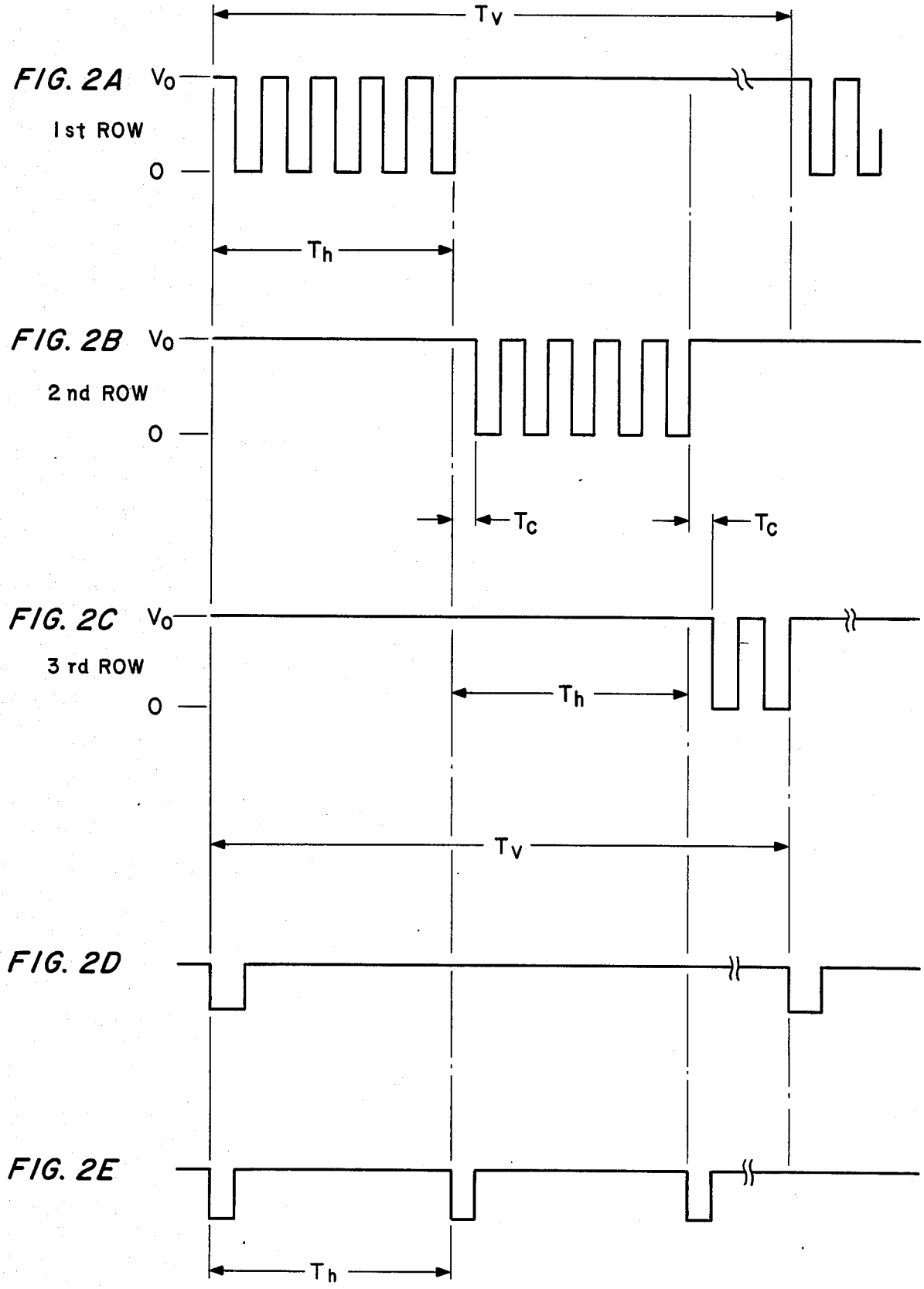
FIGS. 2A to 2E are waveform diagrams showing a pulse train applied at scanning electrodes in a time-division mode.

Needless to say, in order to drive a conventional plasma display panel, the scanning electrode group is selected for the period $T_h$ with the horizontal synchronizing signals shown in FIG. 2E. The first electrodes have a pulse train applied thereto with the peak value of $V_0$ shown in FIG. 2A. After a certain period (blanking period), the second scanning electrode is selected. The pulsed voltage having the peak value of $V_0$ is applied to the second scanning electrode only for the period $T_h$. (Refer to FIG. 2B.) The third scanning electrode has a pulsed voltage applied thereto after a pulsed voltage is applied to the second scanning electrode. This operation is repeated sequentially until the time when vertical synchronizing signal arrives or for the period $T_v$. The circuit then returns to the state which allows a selection of the first scanning electrode when the vertical synchronizing signal arrives.

According to this invention, each of the scanning electrodes is sequentially scanned with horizontal synchronizing signals. The circuit is returned to the initial state with a vertical synchronizing signal which is inputted after all the scanning electrodes are scanned. The vertical synchronizing signal is coincidental to the refresh frequency in display and generally is determined as being 55 cycles or higher.

An example will be described below for the case wherein a plasma display panel having display cells of 640×400 dots is driven by the aforementioned driving method.

The applied voltage $V_0$ shown in FIG. 1A was set at 180 V, its frequency at 800 KHz. The applied voltage $V_1$ in FIGS. 1B, and 1C were set at 30 V, their frequency at 800 KHz, the period $T_a$ at 20 micro sec., and the period $T_b$ at 10 micro sec. The plasma display panel shows stable performance without erroneous discharge to obtain the following results:

| | Prior art phase-select method | This invention method |
|---|---|---|
| Power | 40 W | 28 W |
| Brightness | 10 fL | 9.4 fL |

As shown above, when the address mode at the period $T_a$ and the hold mode at the period $T_b$ have the same frequency, the power consumption will be decreased by an increase of the period $T_b$, but this inevitably entails a decrease in brightness. It is, therefore, preferable to design the period $T_b$ shorter than the period $T_a$.

A description will now be given of an example which can reduce the power consumption and still increase the brightness.

FIG. 3 shows arrangement of pulse trains of the second embodiment.

Figures 3A, 3B, 3C, 3D, 3E:
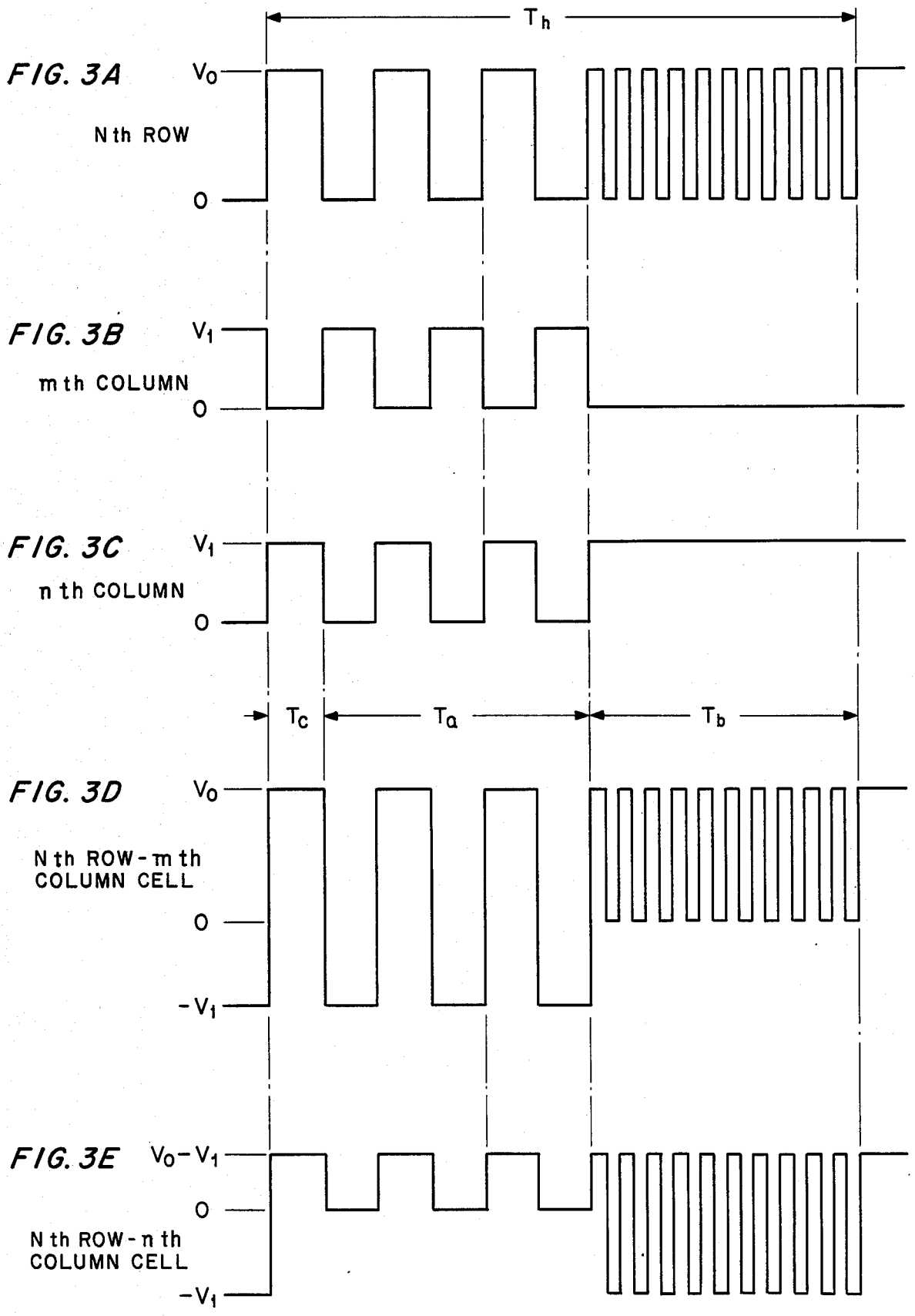
FIGS. 3A to 3E are waveform diagrams showing a relationship between the voltage applied to a scanning electrode and data electrodes, according to a second preferred embodiment of this invention.

FIG. 3A shows a pulse train of peak voltage $V_0$ applied on the scanning electrodes at the Nth row in a plasma display panel.

FIG. 3B shows a pulse train of peak voltage $V_1$ applied on the data electrodes of the mth column. FIG. 3C shows the pulse train of peak voltage $V_1$ applied on the data electrodes of the nth column.

FIG. 3D shows the pulsed potential difference applied on the selected (the Nth row, the mth column) cells defined at the intersections of the Nth row electrodes and the mth electrodes. FIG. 3E shows the pulsed potential difference applied on the non-selected (Nth row, the nth column) cells formed at the intersections of the Nth row electrodes and the nth column electrodes.

In the drawings, the period represented by the letter $T_c$ is the blanking time while the period represented by the letter $T_a$ is the time when a display is made in the address mode. The period represented by the letter $T_b$ is the time when a display is made in the hold mode. The sum of the periods, $T_a+T_b+T_c$, indicates one scanning time $T_h$ where one scanning electrode is being selected.

An example where a plasma display panel having the display points of 640×400 dots is driven with the pulsed voltages shown in FIG. 3 is described below.

When the voltage $V_0$ shown in FIG. 3A was set at 170 V, the frequency in the address mode at 500 KHz, the frequency in the hold mode at 2 MHz, the voltage $V_1$ shown in FIGS. 3B and 3C at 30 V, its frequency in the address mode at 500 KHz, and the frequency in the hold mode in DC, the panel showed a stable operation.

The following table shows the comparison of the power consumption and brightness of the plasma display panel driven by this invention method under the above conditions, and the plasma display panel driven by the prior art phase-select method (driven by 800 KHz).

| | Power consumption | Brightness |
|---|---|---|
| Phase-select method | 40 W | 10 fL |
| This invention method | 15 W | 12 fL |

The power consumption and brightness changed in proportion to the ratio between the time period $T_a$ in address mode and the period $T_b$ in hold mode in FIG. 3. The ratio was set at 1:2 in the above example.

In the second example, the power consumption can be reduced. At the same time, the brightness can be increased by lowering the frequency in the address mode and increasing the frequency in the hold mode. The frequency during the period $T_a$ may be selected from the range of 400 KHz to 600 Hz. The frequency for the period $T_b$ may be selected from the range of 1.5 MHz to 3 MHz. It is preferable that the duration of the period $T_b$ is 1 to 2.5 times the duration of the period $T_a$.

Figures 4A, 4B, 4C, 4D, 4E:
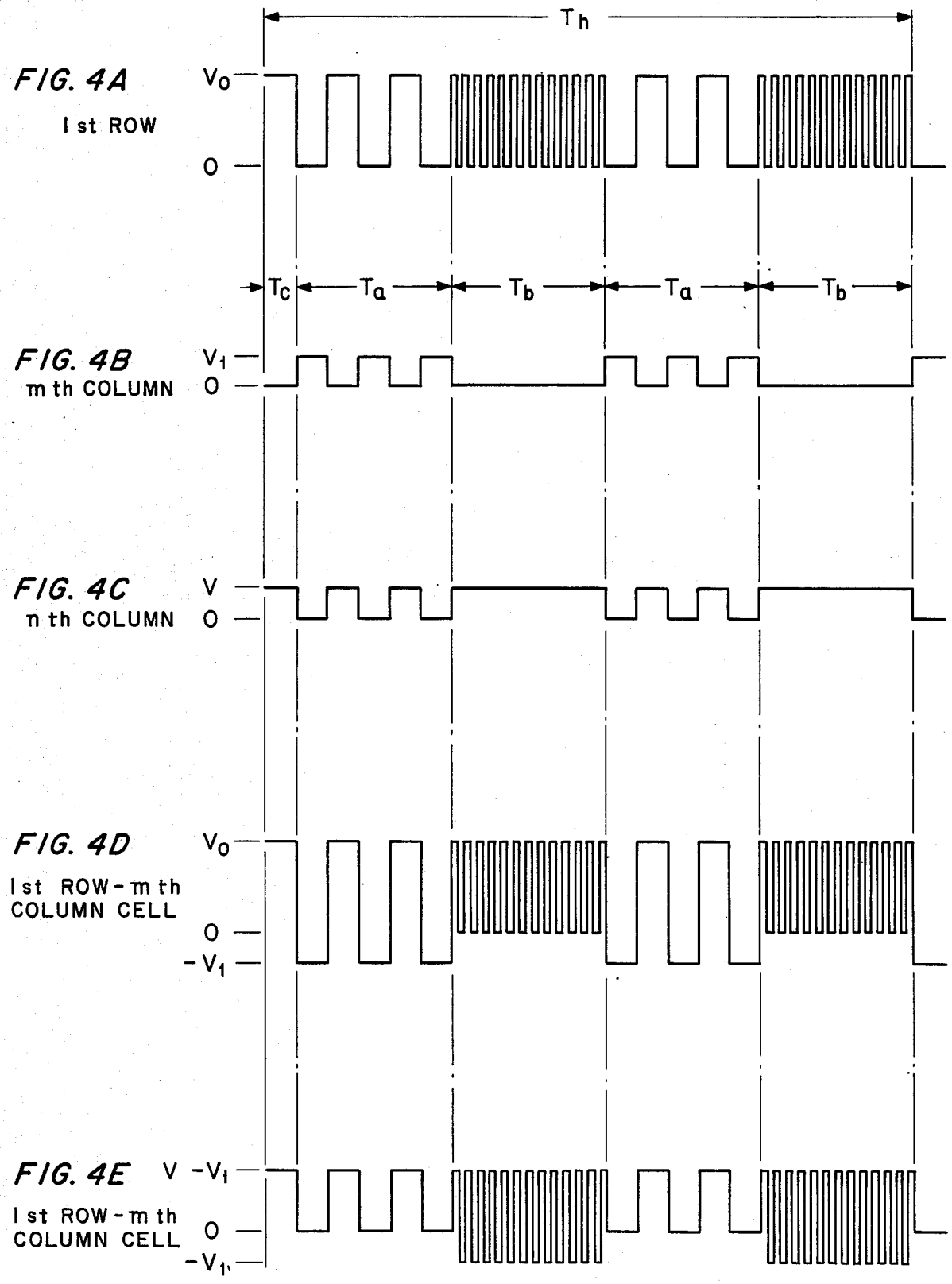
FIGS. 4A to 4E are waveform diagrams showing a relationship between the voltages applied to a scanning electrode and data electrodes, according to a third preferred embodiment of this invention.

The third example is now described. FIG. 4 shows the voltage waveform applied to the respective electrodes of the third example. FIG. 4A shows the pulse train of peak voltage $V_0$ applied to the scanning electrode in the Nth row for one scanning period Th. As shown in the drawing, the period $T_a$ is an address mode, and the period $T_b$ a hold mode, and the period $T_c$ a blanking mode.

While the Nth row electrodes are being scanned, as shown in FIG. 4B, the mth column electrode has applied thereto a pulse train of peak voltage $V_1$ with the phase opposite to the phase of the pulse train applied on the Nth row electrodes. Therefore, the selected cell of (the Nth row, the nth column) at the intersection of the Nth row electrode and mth column electrode has applied thereto the pulsed potential difference having the amplitude of $V_0+V_1$ at the address mode as shown in FIG. 4D. Since the amplitude is selected to be higher than $VD_{max}$, the selected cell of (the Nth row, the nth column) is lit in display.

The pulse train of peak voltage $V_1$ is applied to the nth column electrode and the pulse train of peak voltage $V_0$ is applied to the Nth row electrode, with the same phase. Therefore, the display cell of the Nth row, the nth column has the potential difference of $V_0-V_1$ at the address mode and does not discharge.

The display cells which started to discharge in the period $T_a$ and the cells which did not start to discharge in the period $T_a$ have applied thereto high frequency pulses having the potential difference of $V_0$ in the subsequent period $T_b$. The voltage is applied in the period $T_b$ is selected to be higher than the voltage required to start a unilateral discharge. If the duration of the period $T_b$ is sufficiently long (or more than 20 micro sec.), the non-selected cell (the Nth row, the nth column) will start to discharge in the hold mode. However, if the hold mode is switched to the address mode before the non-selected cell starts to discharge in the period $T_b$, the potential difference applied on the non-selected cell becomes $V_0-V_1$ to prevent the non-selected cell from discharging both in the periods $T_a$ and $T_b$. As stated above, a stable display can be obtained by providing an address mode, a hold mode, an address mode and a hold mode within one scanning period $T_h$.

A description will now be given of an example where a panel having display cells of 640×400 dots is driven by pulse waveforms shown in FIG. 4.

The panel was driven by setting one scanning time at 43 micro sec., blanking period $T_c$ at 3 micro sec., an address mode period $T_a$ at 10 micro sec., a hold mode period $T_b$ at 10 micro sec., $V_1$ at 30 V, the frequency in the address mode at 500 KHz, the frequency in the hold mode at 2 MHz. The panel was operated stably with the voltage $V_0$ ranging from 163 V to 175 V.

When compared to a plasma display panel driven by the prior art phase-select method with a frequency of 800 KHz, this invention method improves the brightness by a factor 1.1, the power consumption by 50%, and the operating voltage range by two fold.

As described above, the plasma display panel according to this invention can remarkably improve the brightness, power consumption and operating voltage range.

Figure 5:
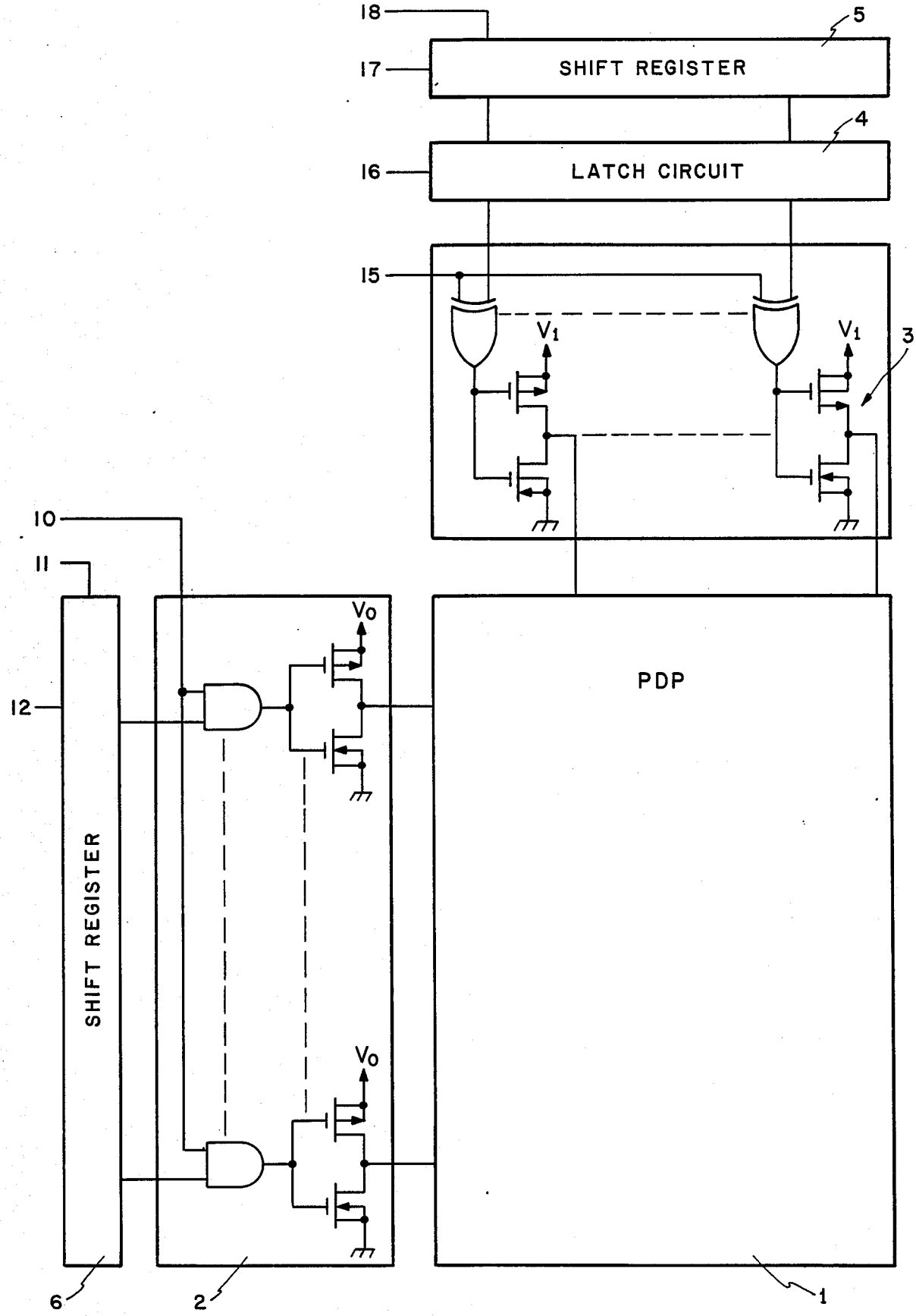
FIG. 5 is a block diagram of a driving circuit for a plasma display panel according to the first preferred embodiment of this invention.

FIG. 5 is a block diagram showing a plasma display system according to the present invention. The plasma display system comprises a matrix display type of plasma display panel 1, a driving circuit for the row electrode group 2, a driving circuit for the column electrode group 3, a latch circuit 4 for storing data, a shift register 5 for storing data temporarily, and a shift register 6 for sequentially shifting row electrodes.

The pulse train of peak voltage $V_0$ which is to be applied at row electrodes is generated by a complimentary inverter circuit at the last stage of the driving circuit 2 and has the peak value of $V_0$. The input signals of this circuit 2 are the output from the shift register 6 and the high frequency pulse signal 10 which is inputted from the outside and which are mixed at an AND gate. The output signal of the AND gate is amplified up to the value of high voltage source $V_0$, by the inverter circuit. Thus, the high frequency pulse signal which is inputted from outside and the output from the driving circuit 2, at the last stage, have the same frequency of opposite phases. The shift register 6 receives scanning data signal 11 and scanning clock signal 12 as an input. The scanning data signal 11 is sequentially transferred by the scanning clock signal 12 to the AND gate in the driving circuit 2.

The column electrodes driving circuit 3 comprises a complementary inverter circuit which receives the output from an exclusive OR circuit as an input which is to be inverted at the driving circuit. The data inputted at the shift register 5 via the dot data input 17 and the data shift clock shift 18 are transmitted to the latch circuit 4 by latch pulse signal 16. The outputs from the latch circuit 4 are inputted at the exclusive OR circuit in the driving circuit 3 to be mixed with the high frequency pulse signal 15 which inputted from outside. If there is no output from the latch circit 4, the output from the exclusive OR circuit has a phase which is opposite to the phase of the high frequency pulse signal 15 which is inputted from outside. The high frequency pulse 15 is then amplified up to the value of voltage source $V_1$, by the inverter circuit. Thus, the pulse train obtained from the column electrodes driving circuit 3 has a phase which is the same as the phase of the high frequency pulse signal 15. Conversely, if there is an output from the latch circuit 4, the output from the exclusive OR circuit has a phase which is identical to the phase of the high frequency pulse signal 15, inputted from outside. The pulse train in the output circuit has the phase opposite thereto.

The DC voltage needed for a hold mode can be obtained by converting the high frequency pulse signal 15 to a DC signal. The conversion in frequency which is necessary for the hold mode, as in the second preferred embodiment, may be conducted by switching the frequency of the high frequency pulse signal 10 that is inputted from outside.

According to the present invention, during the period while the voltage is similar to the prior art phase-select method, the power consumption is applied is identical to the power consumption in the prior art method. However, the power consumed is remarkably reduced in the period while the voltage is entirely irrelevant to the waveform applied to the scanning electrodes or while the direct current voltage is applied to the data electrodes. This reduction occurs because the power consumed between adjacent data electrodes becomes negligible.

Further the driving becomes stable with a smaller power consumption in this inventive circuit by lowering driving frequency for the period of driving which is similar to the phase-select method, and by increasing the frequency of the period when DC voltage is being applied to data electrodes.

What is claimed is:

1. A plasma display apparatus comprising a first electrode group and a second electrode group disposed in an opposed relation relative to each other, the space intermediate the opposed electrode groups being filled with a discharge gas to form cells therebetween, the plasma display comprising:

first means for applying a first pulse train of a first voltage to said first electrode group for a first period at a predetermined interval and in a time division mode, second means for applying a second pulse train of second voltage to at least one selected electrode in said second electrode group for a second period which is shorter than said first period, said second pulse train being applied in synchronism and in combination with said first pulse train so as to produce a first pulsing potential difference between the electrodes associated with a selected cell, said first pulsing potential difference being larger than a firing voltage of said cell, third means for applying to non-selected electrodes in said second electrode group and during said second period a third pulse train of third voltage pulses in synchronism with said first pulses train so as to produce a second pulsing potential difference between the electrodes associated with non-selected cells in combination with said first pulses trains, said second pulsing potential difference being less than the firing voltage of said cell, fourth means for applying a first direct-current voltage component in combination with said first pulse train to said at least one selected electrode in said second electrode group during a third period which is shorter than said first period, said third period being after the application of said second voltage pulses so as to produce a third pulsing potential difference between the electrodes associated with said selected cell, said third pulsing potential difference being smaller than the firing voltage of said cell, but also being enough larger to continue the discharge of said selected cell due to a previously discharging state of said selected cell, and fifth means for applying a second direct-current voltage component in combination with said first pulse train to said non-selected electrodes in said second electrode group for said third period after the application of said third pulse train so as to produce a fourth pulsing potential difference between the electrodes associated with said non-selected cell, said fourth pulsing potential difference being less than the firing voltage of said cell, the period of applying said fourth pulsing potential difference being smaller than the period required to cause a discharge of said non-selected cell.

2. The apparatus of claim 1, wherein said first pulse train includes a first pulse train portion having pulses of a first frequency and continuing for said second period, and a second pulse train portion having pulses of a second frequency which is higher than said first frequency and continuing for said third period.

3. The apparatus of claim 1, wherein the phase of said second pulse train is opposite to the phase of said first pulse train and the phase of said third pulse train is identical to the phase of said first pulse train.

4. The apparatus of claim 3, wherein the amplitude of said second pulse train is the same as the amplitude of said third pulse train.

5. The apparatus of claim 3, wherein the frequency of said first pulse train in said second period pulsing potential difference is smaller than the frequency of said first pulse train in said third period.

6. A plasma display apparatus comprising a first electrode group and a second electrode group disposed in an opposed relation relative to each other, the space intermediate the opposed electrode groups being filled with a discharge gas to form cells therebetween, the plasma display comprising:

first means for applying a first pulse train of a first voltage of said first electrode group for a first period at predetermined intervals and in a time division mode, second means for applying a second pulse train of a second voltage to at least one selected electrode in said second electrode group for a second period which is shorter than said first period, the phase of said second pulse train being opposite to the phase of said first pulse train in order to produce a first pulsing potential difference between the electrodes associated with a selected cell, said first pulsing potential difference being larger than a firing voltage of said cell, third means for applying to non-selected electrodes in said second electrode group and during said second period a third pulse train of said second voltage, the phase of said third pulse train being identical to the phase of said first pulses train in order to produce a second pulsing potential difference between the electrodes associated with non-selected cells in combination with said first pulses trains, said second pulsing potential difference being less than the firing voltage of said cell, fourth means for applying a first direct-current voltage component in combination with said first pulse train to said at least one selected electrode in said second electrode group during a third period which is shorter than said first period, said third period being after the application of said second voltage pulses so as to produce a third pulsing potential difference between the electrodes associated with said selected cell, said third pulsing potential difference being smaller than the firing voltage of said cell, but also being enough larger to continue the discharge of said selected cell due to a previously discharging state of said selected cell, the frequency of said third pulse train in said third period being higher than the frequency of said first pulse train in said second period, and fifth means for applying a second direct-current voltage component in combination with said first pulse train to said non-selected electrodes in said second electrode group for said third period after the application of said third pulse train so as to produce a fourth pulsing potential difference between the electrodes associated with said non-selected cell, said fourth pulsing potential difference being less than the firing voltage of said cell, the period of applying said fourth pulsing potential difference being smaller than the period required to cause a discharge of said non-selected cell.

* * * * *